US006530721B2

(12) United States Patent
Yost

(10) Patent No.: US 6,530,721 B2
(45) Date of Patent: Mar. 11, 2003

(54) METHOD FOR CONTROL SYSTEM SETUP

(75) Inventor: Jerald W. Yost, Casstown, OH (US)

(73) Assignee: Trimble Navigation Limited, Sunnyvale, CA (US)

( * ) Notice: Subject to any disclaimer, the term of this patent is extended or adjusted under 35 U.S.C. 154(b) by 7 days.

(21) Appl. No.: 09/766,291

(22) Filed: Jan. 19, 2001

(65) Prior Publication Data

US 2002/0127059 A1 Sep. 12, 2002

(51) Int. Cl.[7] ..... E01C 23/01; E01C 19/26
(52) U.S. Cl. ..... 404/84.5; 404/118
(58) Field of Search ..... 404/72, 84.05, 404/84.1, 84.5, 118, 120, 104

(56) References Cited

U.S. PATENT DOCUMENTS

| | | | | | |
|---|---|---|---|---|---|
| 3,181,441 | A | | 5/1965 | Flom | |
| 3,674,094 | A | * | 7/1972 | Kuntz | 172/2 |
| 3,953,145 | A | * | 4/1976 | Teach | 404/84 |
| 4,655,633 | A | | 4/1987 | Somero et al. | |
| 4,752,156 | A | | 6/1988 | Owens | |
| 4,925,340 | A | * | 5/1990 | Heiser et al. | 404/75 |
| 4,930,935 | A | | 6/1990 | Quenzi et al. | |
| 5,039,249 | A | | 8/1991 | Hansen et al. | |
| 5,044,820 | A | | 9/1991 | Prang | |
| 5,078,215 | A | | 1/1992 | Nau | |
| 5,107,932 | A | | 4/1992 | Zachman et al. | |
| 5,129,803 | A | | 7/1992 | Nomura et al. | |
| 5,156,487 | A | * | 10/1992 | Haid | 404/72 |
| 5,288,166 | A | | 2/1994 | Allen et al. | |
| 5,288,167 | A | * | 2/1994 | Gaffard et al. | 404/84.05 |
| 5,328,295 | A | | 7/1994 | Allen | |
| 5,356,238 | A | * | 10/1994 | Musil et al. | 404/84.1 |
| 5,401,115 | A | * | 3/1995 | Musil et al. | 404/72 |
| 5,556,226 | A | | 9/1996 | Hohmann, Jr. | |
| 5,886,776 | A | * | 3/1999 | Yost et al. | 356/141.3 |
| 6,129,481 | A | * | 10/2000 | Tapio et al. | 404/102 |
| 6,227,761 | B1 | * | 5/2001 | Kieranen et al. | 404/84.5 |

* cited by examiner

*Primary Examiner*—Thomas B. Will
*Assistant Examiner*—Raymond W Addie
(74) *Attorney, Agent, or Firm*—Killworth, Gottman, Hagan & Schaeff LLP

(57) ABSTRACT

A machine having a tool with hydraulically moveable ends, for example as a screed head, is setup for operation by using an inclinometer or other sensor to determine the orientation of the tool. According to this method, the on grade elevational position of the first end of the tool with respect to the reference is selected, and the first end of the tool is then moved to the desired elevational position while an elevation receiver at the first end detects the reference, such as a beam of laser light. The on grade orientation of the tool along its length from one end to the other is selected, and the second end of the tool moved until the on grade orientation of the tool along its length is sensed. The reference is then detected with the elevation receiver at the second end of the tool. The detected positions of the reference at the first and second ends of the tool are then stored as on grade positions. The elevational positions of the ends of the tool are controlled to be on grade during operation in relation to the reference detected by elevation receivers.

10 Claims, 5 Drawing Sheets

METHOD FOR CONTROL SYSTEM SETUP

CROSS REFERENCE TO RELATED APPLICATIONS

Not applicable.

BACKGROUND OF THE INVENTION

The present invention relates to a control system for controlling movement of a tool carried by a machine and, more specifically, to a control system for controlling movement of individual hydraulically moveable ends of a tool which carries laser receivers, even when one of the receivers does not receive the transmitted plane of reference light.

In concrete paving operations, after concrete is poured, it is commonly finished by drawing a tool, such as a screed head, over the surface of the concrete. This smooths the surface of the concrete before it cures. In asphalt paving operations, after asphalt is laid, it is commonly leveled to a desired depth by drawing a tool, such as also a screed head of a paver, over the surface of the contour. Finally, in grading operations, a surface is graded to a desired depth by drawing a tool, such as a blade of a grader, over the surface of the contour. Thus, although the physical configurations of the types of screed heads and the grader's blade are not identical, the functions of these tools are analogous.

Typically, hydraulic cylinders connected to each end of the tool of the machine are used to raise and lower the ends of the tool independently. It has been common to determine the elevational positions of the ends of the tool by using a laser transmitter which provides a rotating beam of laser light, effectively producing a reference plane. The raising and lowering of the tool are controlled by a control system that has a predetermined desired eleveational position for the surface.

A pair of laser receivers, one receiver mounted at each end of the tool on an associated mast for vertical movement with the tool, detects the reference plane and the relative elevation of the ends of the tool with respect to the reference plane. A control system of the machine then actuates hydraulic valves to supply fluid to the hydraulic cylinders in response to these detected levels. As a result, the elevation of each end of the tool can be precisely controlled. Each of the receivers provides elevational feedback to drive the hydraulics controlling the elevation of the end of the tool with which it is associated.

Prior to operating a machine of this type, a machine setup operation has been performed. This has been accomplished by first setting the laser transmitter in a location that will minimize the occurrence of beam blockage from any surrounding obstructions. The operator then uses a grade rod with a handheld beam detector to transfer the sight benchmark to the tool. The typical method of setting up a screed machine has been to place the grade rod on a rod platform provided specifically for this purpose on the left side of the screed head. The laser receiver on the left side of the screed head is then adjusted up or down(causing the screed head to move up or down) until the hand-held laser receiver indicates that an on-grade position has been reached. At this point, the elevation of the left laser receiver is locked and the procedure repeated on the right side.

The disadvantage of this method is that very small setup errors at opposite ends of the screed head become readily apparent when the screed machine is used. If the operator is not careful, it is easy for one side of the screed head to be ⅛ inch lower than the correct elevation and the other side of the screed head to be ⅛ inch higher than the correct elevation. This would result in a total deviation from one end to the other of ¼ inch. Since each pass of the screed head over the surface of the concrete causes areas that are smoothed by the screed head at one end to abut other areas that are smoothed by the screed head at its opposite end, such deviations would be very apparent, as the final floor surface has a sawtooth grade with a series of ¼ inch discontinuities.

It is seen, therefore, that there is a need for a control system and method for controlling movement of individually hydraulically moveable ends of a tool, such as a screed head, to maintain a selected elevational position between each end of the tool and an elevation reference in which the setup of the control system is facilitated to reduce errors.

SUMMARY OF THE INVENTION

This need is met by the method the present invention for setup of a control system for a machine having a tool with hydraulically moveable ends, such as a screed head. The elevational positions of the ends of the tool and the orientation of the tool along its length from one end to the other being controlled to be on grade during operation in relation to a reference detected by elevation receivers attached to the ends of the tool. According to this method, the on grade elevational position of the first end of the tool with respect to the reference is selected, and the first end of the tool moved to the desired elevational position with the elevation receiver at the first end detecting the reference. The on grade orientation of the tool along its length from one end to the other is selected, and the second end of the tool moved until the on grade orientation of the tool along its length is sensed. The reference is detected with the elevation receiver at the second end of the tool, and the detected positions of the reference at the first and second ends of the tool are stored as on grade positions.

The step of moving the second end of the tool until the on grade orientation of the tool along its length is sensed may include the step of sensing the orientation of the tool using an inclinometer. The inclinometer is preferably permanently attached to the tool.

The elevation receivers are preferably light detectors and the reference is preferably a rotating beam of light. Even more preferably, the elevation receivers may be laser light detectors and the reference is a rotating beam of laser light.

Other objects, features and advantages will appear more fully in the course of the following discussion.

DETAILED DESCRIPTION OF THE INVENTION

Figure 1:
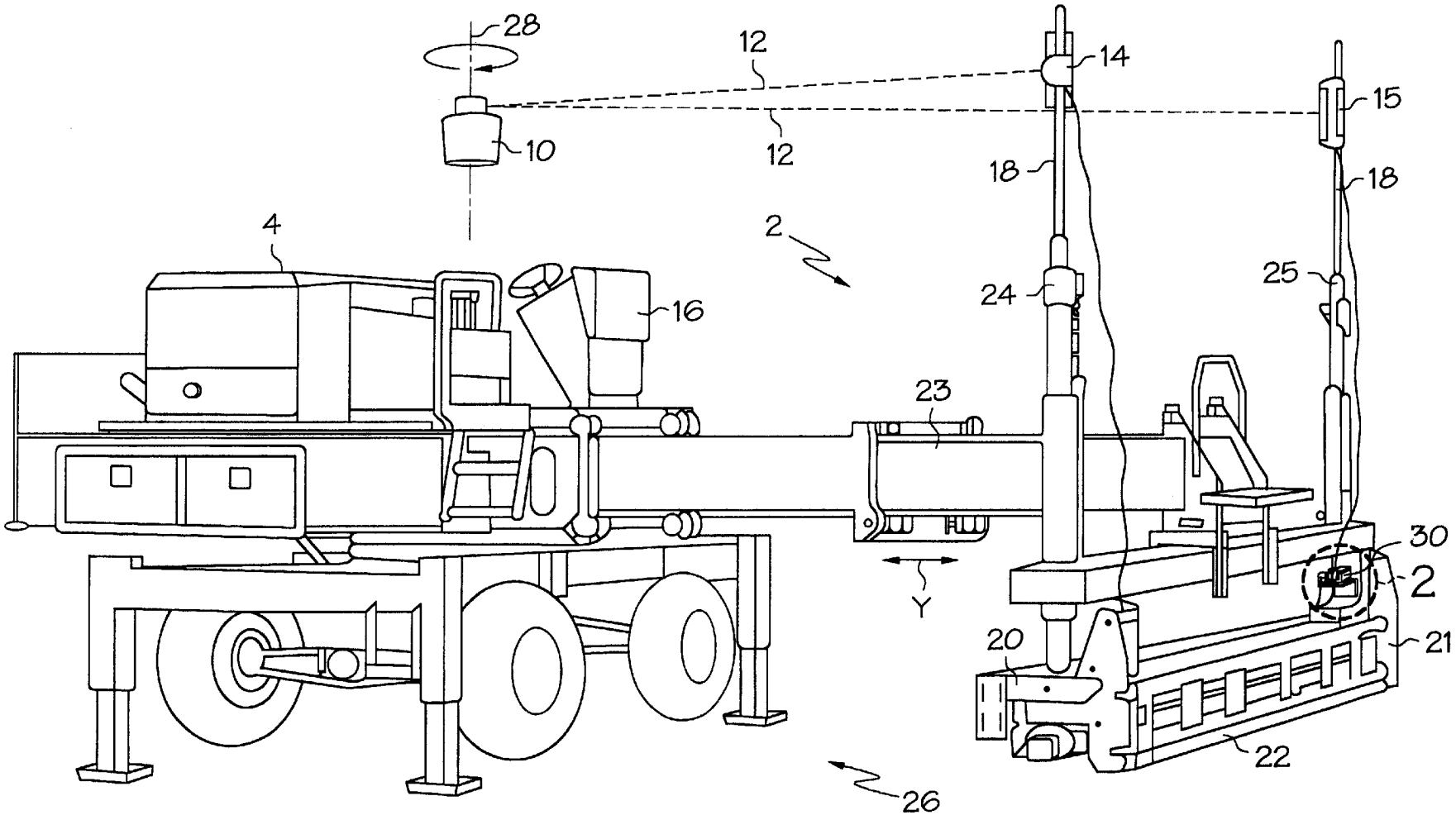
FIG. 1 illustrates a screeding operation of a typical concrete screed utilizing the control system of the present invention and adapted for setup according to the present invention.

Referring to FIG. 1 of the drawings, the device implementing the preferred embodiment of invention herein is a control system for a machine 2, such as a concrete screed 4, that typically incorporates a laser transmitter 10 mounted in a stationary position. The transmitter 10 projects a rotating laser beam 12, in order to provide a reference. A pair of elevation receivers, such as laser receivers 14 and 15, and a control box 16 including a control circuit are provided for controlling electro-hydraulic control values (not shown) of the concrete screed 4. The concrete screed 4 further includes a pair of masts 18, each carrying one of the pair of laser receivers 14 and 15, attached with and moved generally vertically, independently, with respective ends 20 and 21, respectively, of a tool or screed head 22. The screed head 22 is attached to the end of a hydraulic boom arm 23 which moves the screed head 22 in longitudinal direction Y. During operation of the screed, the control box 16 causes actuation of the hydraulic valves such that hydraulic cylinders 24 and 25 at the ends 20 and 21, respectively, independently raise or lower the ends 20 and 21 of the screed head 22, as needed, as it is drawn in the direction Y over the surface of uncured concrete 26. It is to be appreciated that the raising and lowering of the screed head 22 in the vertical direction are accomplished in response to reception of the reference laser beam 12 by the pair of laser receivers 14 and 15. The laser beam 12 rotates about an axis, as indicated at 28, so as to define the reference as a reference plane of laser light. The first and second receivers 14 provide respective first and second signals indicating the position of the respective ends of the screed head 22 in relation to the reference 12.

Figure 2:
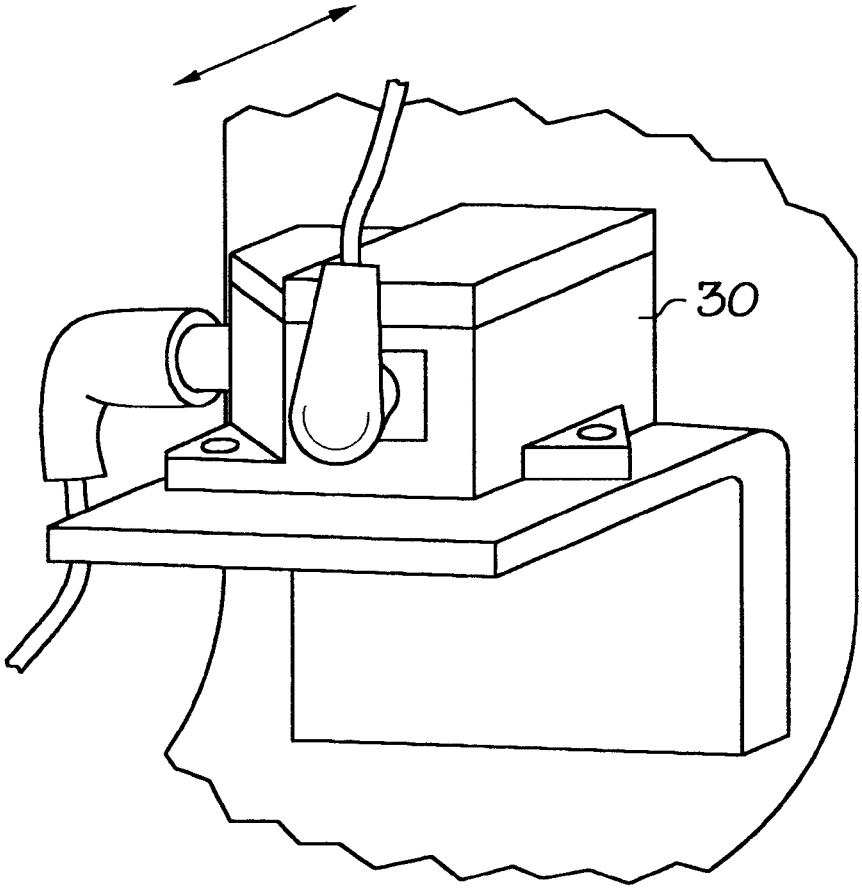
FIG. 2 is an enlarged partial view of an inclinometer mounted on the screed head.

As discussed above, a difficulty arises with the conventional control system of this type when the path of the laser beam 12 to one of the pair of elevation receivers 14 is temporarily blocked by a column or other obstruction at a work site. In the present invention, this difficulty is addressed by the use of a sensor 30, mounted on the screed head 22, for sensing the orientation of the screed head 22 along its length from the first end to the second end. The sensor 30 preferably is an inclinometer that is mounted on the screed head as best shown in FIG. 2. The sensor 30 provides a third signal that indicates the orientation of the screed head. A control circuit in box 16 is responsive to the elevation receivers 14 and 15 and to the sensor 30 for controlling the hydraulically moveable ends 20 and 21 of the screed head 22 using the first and second signals from the elevation receivers 14 and 15 when the first and second signals are available, and for controlling the hydraulically movable ends 20 and 21 of the screed head 22 using the third signal from the sensor 30 and one of the first and second signals from the elevation receivers 14 and 15 when the other of the first and second signals is not available. The control circuit maintains the screed head 22 in an orientation such that the third signal remains substantially constant when one of the first and second signals from the elevation receivers 14 and 15 is not available. By this approach, the screed head is also maintained in a substantially constant orientation along its length from the first end to the second end.

Figure 3:
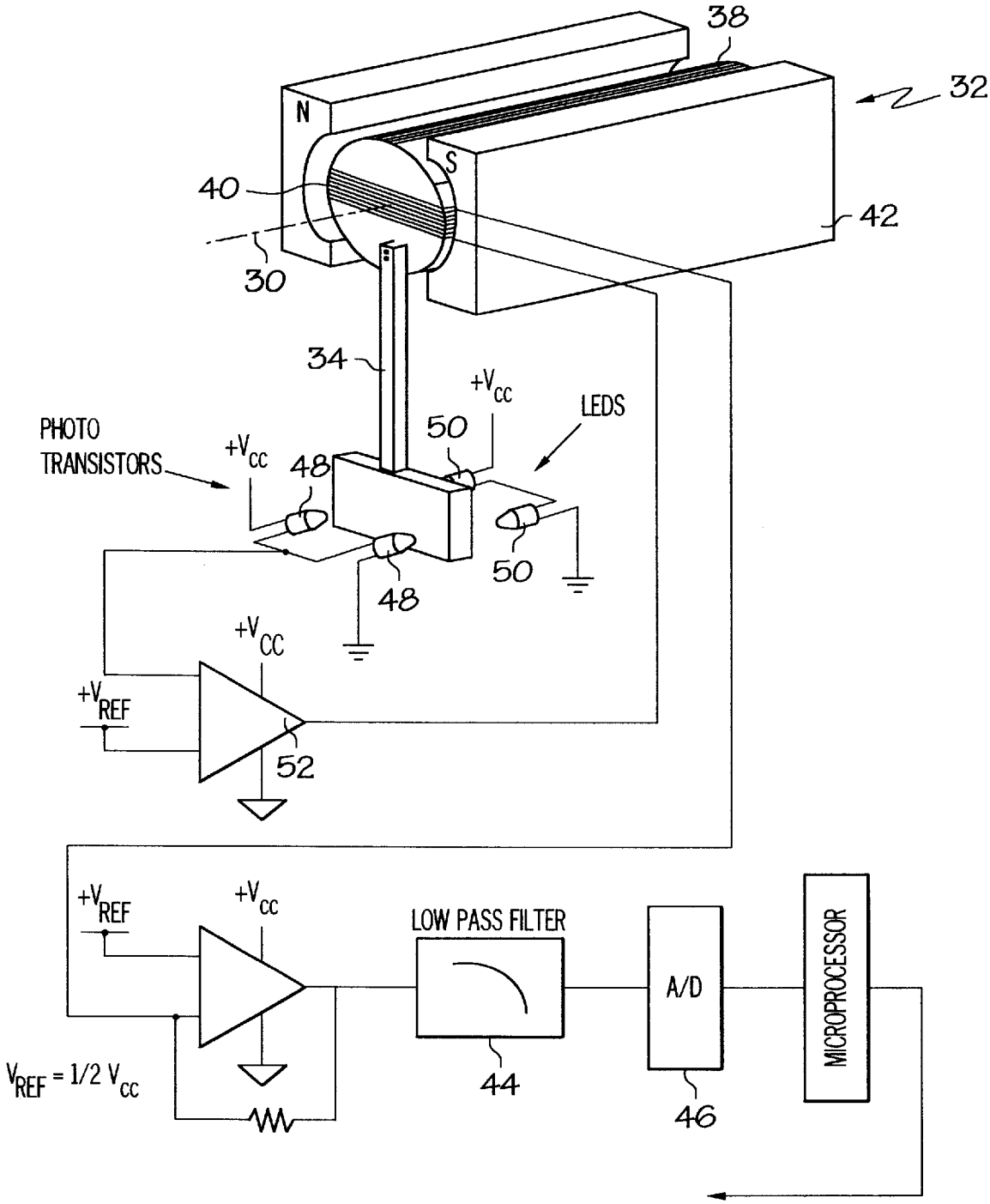
FIG. 3 is a schematic representation of an inclinometer and associated circuitry of the type incorporated in the present invention.
Figure 4:
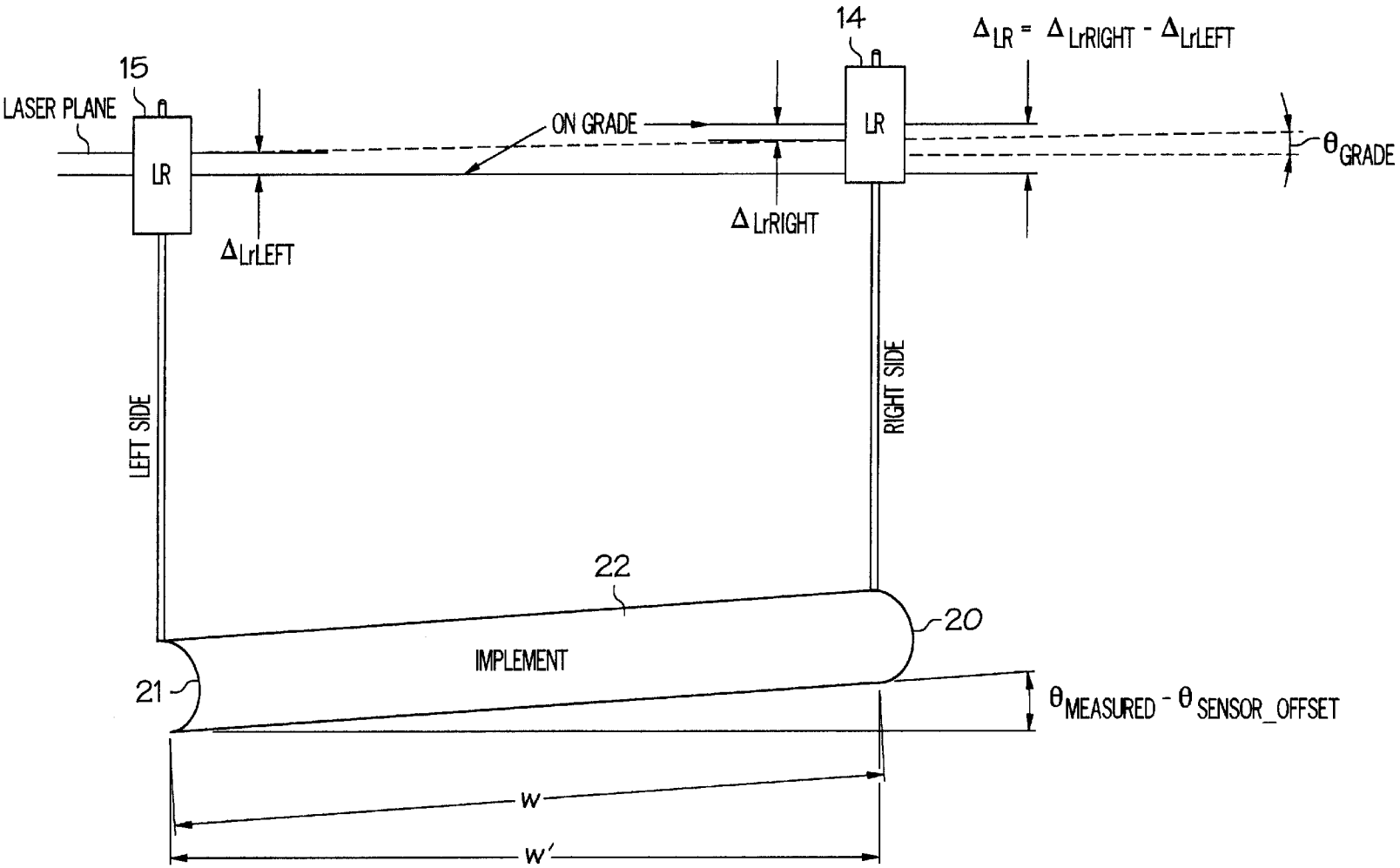
FIG. 4 is a schematic representation of a screed head, and elevation receivers, illustrating a technique for adjusting for offsets in inclinometer mounting.

As stated above, the sensor 30 is preferably an inclinometer. An appropriate inclinometer 32 and associated circuitry is shown in FIG. 3. As will be apparent, the inclinometer 32 is a pendulum sensor that incorporates a pendulum arm 34 which pivots about axis 36, moving rotor 38. Rotor 38 includes a plurality of windings 40 which rotate with the rotor and cooperate with a permanent magnet stator 42. The output of the windings 40 is supplied to with a low pass filter 44 and is then digitized in A-D converter 46. As will be appreciated photo transistors 48 cooperate with LED's 50 to determine when the inclinometer has been pivoted sufficiently that the pendulum 34 does not prevent the light from the LED's 50 from striking the transistors 48. When one of the transistors 48 is illuminated, a signal is applied to amplifier 52 which then drives windings 40 until the pendulum 34 is brought back into position to shield both of the photo transistors 48. The amplitude of this driving current provides an indication of the degree of inclination of the sensor 30.

It will be appreciated that the sensor 30 may not be mounted in perfectly horizontal position on the screed head 22. If one were to assume that when the receivers 14 and 15 were on grade, i.e., at a position that indicates by appropriate receipt of the laser beam 12 that the screed head 22 is positioned at the correct height and orientation, the inclinometer 30 would read zero slope, and the algorithm of the slope control system would be relatively simple. The controller would simply drive until the slope sensor read zero whenever one of the laser receiver signals was lost. This assumption is not always correct. Rather, the laser plane will have some finite slope to it resulting in elevation offsets and the slope sensor that is mounted to the screed head will also have some slope offset to it (due to the mechanical mounting characteristics). The following algorithm has been provided to deal with these issues.

Variable Definitions:

All angles in the remainder of this document are expressed in terms of slope (rise over run) and are referenced to horizontally flat.

$\Delta_{LrLeft}$ is the deviation from On-Grade point of the laser receiver on the left side.

$\Delta_{LrRight}$ is the deviation from On-Grade point of the laser receiver on the right side.

$A_{Lr}$ is the total vertical error as measured by the laser receivers. It is equivalent to $\Delta_{LrRight}-\Delta_{LrLeft}$.

w is the width of the controlled item.

$\theta_{measured}$ is the angle that is measured by the slope sensor mounted to the controlled item.

$\theta_{sensor_offset}$ is the angular offset of the slop sensor. It is equal to $\theta_{measured}$ when the controlled item is perfectly flat.

w' is the length of the base of a right triangle created from a hypotenuse w and the angle $(\theta_{measured}-\theta_{sensor_offset})$. This is in essence the horizontal component of the controlled item when the controlled item is elevated on one end.

$\theta_{grade}$ is the angle generated from the slope laser beam plane.

$\theta_{measured}-\theta_{sensor_offset}$ is equivalent to $\theta_{grade}$ when the implement is on-grade.

If $\Delta_{Lr}$ is small compared to w, then the approximation $w \approx w'$ can be made.

When the laser strikes both laser receivers 14 and 15 at approximately the same time, the data $\theta_{measured}$, $\Delta_{Lr}$, and w are available.

With this data, $\theta_{offset}$ can be calculated as follows:

$\theta_{sensor_offset}=\theta_{measured}-\theta_{grade}$ but $\theta_{grade}$ is equivalent to $$\frac{\Delta_{LR}}{w}.$$

This makes the assumption that the distance from On-Grade point of the receivers to the cutting edge of the screed head is equivalent on both sides. If this is not the case, an additional offset is created which can be combined with $\theta_{sensor_offset}$ to produce a single angular offset.

Therefore by substituting the following can be derived, $$\theta_{\text{sensor_offset}} = \theta_{measured} - \frac{\Delta_{LR}}{w}$$

Now that $\theta_{sensor_offset}$ is known, if on the next laser sweep, one of the laser signals is missing, the system can drive screed head 22 using a calculated $\Delta_{LR}$ as $\Delta_{LR}=\theta_{measured}-\theta_{sensor_offset}$.

Figure 5:
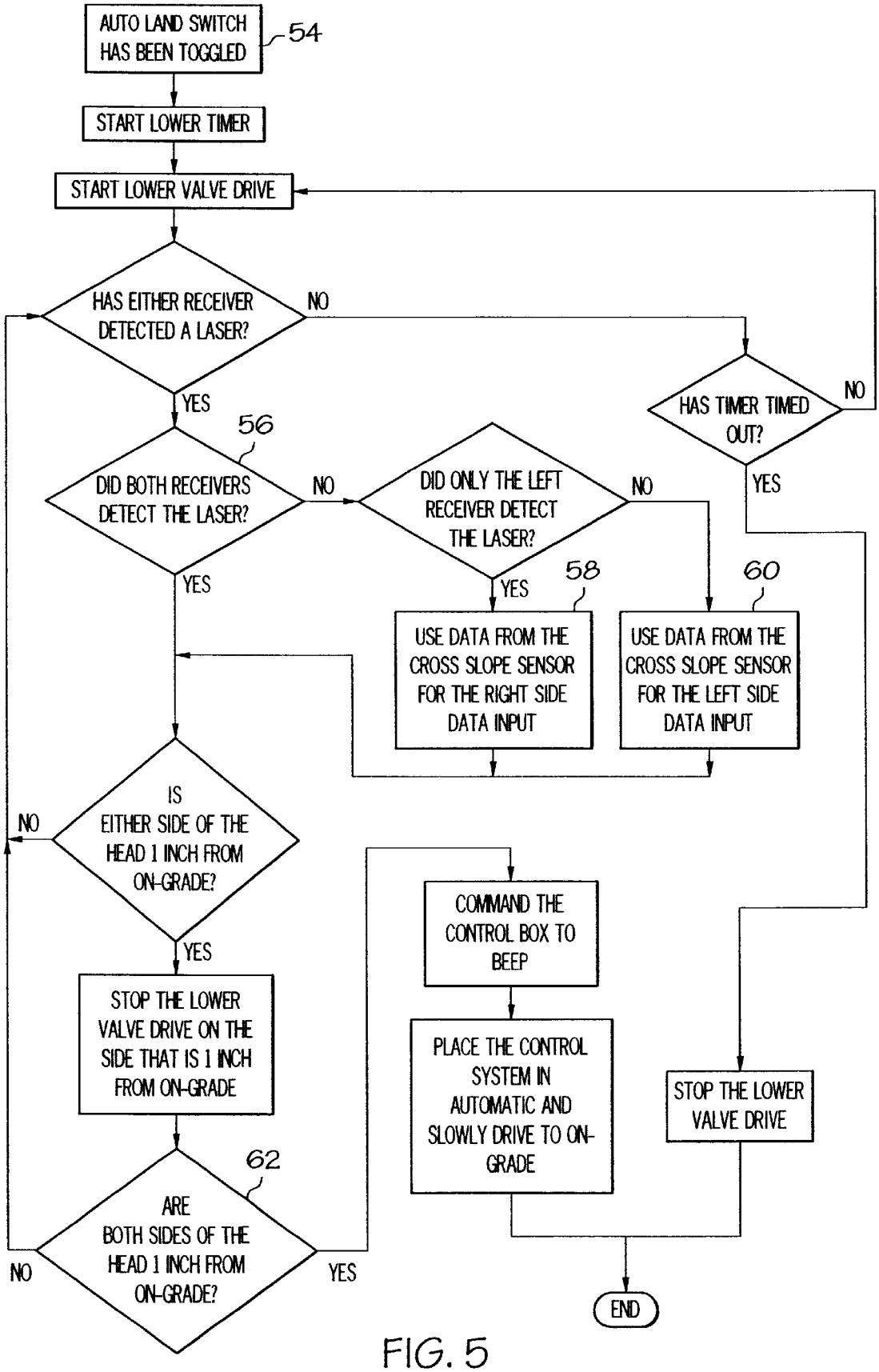
FIG. 5 is a flow chart diagram illustrating operation of the system of the present invention.

Reference is now made to FIG. 5, which is a flow chart diagram illustrating the manner in which the operator smooths the concrete surface as he repeatedly pulls the screed head 22 toward the machine 4. The operator extends the boom 23 and toggles the land switch on control box 16, as indicated at 54. A timer and a lower valve drive are initiated. If either receiver 14 or 15 has detected the laser reference 12 at 56, but not both, then the data from the sensor 30 is used at 58 and 60 in place of the missing data from the receivers. The valve drives for both sides of the screed head are stopped at 62 when the screed head is one inch from being at the correct height, i.e., "on grade." The system is then placed in automatic mode, and the screed head is slowly lowered to the on-grade height. The hydraulic boom arm 23 is then retracted and the screed head smooths the concrete surface 26. If a signal from one of the receivers 14 and 15 is not available during this operation, the control circuit maintains the screed head in an orientation such that the third signal from the sensor 30. By this approach, the slope of the screed head along its length from the first end to the second end also is maintained substantially constant until the receiver 14 or 15 reacquires the beam 12.

Depending upon the configuration of the structure around the concrete surface being smoothed by the screed head, it may not be possible to move the screed head in a straight line toward the machine. It may, for example, be necessary for the operator to shift the beam 23 from side to side to avoid columns and the like as the screed is moved. This will, of course, induce an error in the output of the sensor 30. To avoid this, the lateral movement of the screed head generally in the direction of the length of the screed head 22 is detected. Controlling the elevational positions of the ends of the screed head using the sensed orientation of the screed head is discontinuing until this lateral movement is terminated. With many screed machines the operator must actuate a switch to activate the hydraulic valves to rotate the screed head. The control circuit senses actuation of this switch, and discontinues use of the output of the sensor 30 until rotation of the screed head 22 is terminated.

The present invention contemplates an improved method of setup which facilitates the initiation of operation of the screed machine. As discussed previously, in the past the machine setup operation has been performed essentially manually. The screed machine operator used a grade rod with a handheld beam detector to locate each side of the screed head so that the screed head was on grade. The control circuit then stored the elevation positions of the ends of the screed head that were sensed by the elevation receivers. These stored positions were then compared with the measured positions of the ends of the screed head to generate control signals to adjust the positions of the ends and keep the screed head on grade during operation of the screed. Very small setup errors in using a screed can result in an unacceptable concrete finish. If the setup operation is not accomplished with care, the screed head can be slightly pitched, resulting in a concrete surface that has a saw tooth contour.

The present invention avoids this difficulty by utilizing the sensor 30 as a part of the setup operation. In the present invention, one end of the screed head 22 is adjusted to grade using a grade rod with a handheld beam detector, as described above. The reference beam 12 is detected with the laser receiver 14 or 15 at that end of the screed head 22 and the sensed position stored. The control circuit is then used to drive the screed head 22 to a "level" or desired orientation taken along the length of the screed head, in accordance with the output of the sensor 30. When the screed head 22 has reached this position, the reference beam 12 is detected with the other of the laser receivers 14 and 15 and the sensed position also stored. The two stored positions then define an on grade condition and the ends of the screed head are raised and lowered as needed to maintain this condition. It will be noted that the screed head control system of the present invention permits the setup operation to be performed without additional hardware. It will be appreciated, of course, that this method of setup may also be utilized with systems in which an inclinometer 30, or the like, is not used during the operation of the screed machine, but only at setup. With such a system, the inclinometer may or may not be permanently attached to the screed head.

Having described the invention in detail and by reference to preferred embodiments thereof, it will be apparent that modifications and variations are possible without departing from the scope of the invention defined in the appended claims.

What is claimed is:

1. A method of setup for a control system for a machine having a tool with hydraulically moveable ends, the elevational positions of the ends of the tool and the orientation of the tool along its length from one end to the other being controlled to be on grade during operation in relation to a reference detected by elevation receivers attached to the ends of the tool, comprising the steps of:

(a) selecting the on grade elevational position of the first end of the tool with respect to the reference;

(b) moving the first end of the tool to the desired elevational position with the elevation receiver at the first end detecting the reference;

(c) selecting the on grade orientation of the tool along its length from one end to the other;

(d) moving the second end of the tool until the on grade orientation of the tool along its length is sensed by the control system;

(e) detecting the reference with the elevation receiver at the second end of the tool; and (f) storing the detected positions of the reference at the first and second ends of the tool as on grade positions.

2. A method of setup for a control system according to claim 1 wherein said control system comprises an inclinometer, and wherein the step of moving the second end of the tool until the on grade orientation of the tool along its length is sensed includes the step of sensing the orientation of the tool using said inclinometer.

3. A method of setup for a control system according to claim 2, in which the inclinometer is permanently attached to the tool.

4. A method of setup for a control system according to claim 1, in which the elevation receivers are light detectors and in which the reference is a rotating beam of light.

5. A method of setup for a control system according to claim 1, in which the elevation receivers are laser light detectors and in which the reference is a rotating beam of laser light.

6. A method of setup for a control system for a screed machine having a screed head with hydraulically movable ends, the elevational positions of the ends of the screed head and the orientation of the screed head along its length from one end to the other being controlled to be on grade during operation in relation to a reference detected by elevation receivers attached to the ends of the screed head, comprising the steps of:

(a) selecting the on grade elevational position of the first end of the screed head with respect to the reference;

(b) moving the first end of the screed head to the desired elevational position with the elevation receiver at the first end detecting the reference;

(c) selecting the on grade orientation of the screed head along its length from one end to the other;

(d) moving the second end of the screed head until the on grade orientation of the screed head along its length is sensed by the control system;

(e) detecting the reference wit the elevation receiver at the second end of the screed head; and (f) storing the detected positions of the reference at the first and second ends of the screed head as On grade positions.

7. A method of setup for a control system according to claim 6 wherein said control system comprises an inclinometer, and wherein the step of moving the second end of the screed head until the on grade orientation of the screed head along its length is sensed includes the step of sensing the orientation of the screed head using said inclinometer.

8. A method of setup for a control system according to claim 7, in which the inclinometer is permanently attached to the screed head.

9. A method of setup for a control system according to claim 6, in which the elevation receivers are light detectors and in which the reference is a rotating beam of light.

10. A method of setup for a control system according to claim 6, in which the elevation receivers are laser light detectors and in which the reference is a rotating beam of laser light.

* * * * *

UNITED STATES PATENT AND TRADEMARK OFFICE

CERTIFICATE OF CORRECTION

PATENT NO. : 6,530,721 B2
DATED : March 11, 2003
INVENTOR(S) : Jerald W. Yost

It is certified that error appears in the above-identified patent and that said Letters Patent is hereby corrected as shown below:

Column 4,
Line 34, "$A_{Lr}$" should read -- $\Delta_{Lr}$ --

Column 7,
Line 20, "reference wit the" should read -- reference with the --

Column 8,
Line 2, "as On grade" should read -- as on grade --

Signed and Sealed this

Twenty-ninth Day of July, 2003

JAMES E. ROGAN
*Director of the United States Patent and Trademark Office*